United States Patent [19]

Glocker

[11] 4,207,009

[45] Jun. 10, 1980

[54] GRAVITY FLOW CONTINUOUS MIXER

[76] Inventor: Edwin M. Glocker, 14697 Roxbury Rd., Glenelg, Md. 21737

[21] Appl. No.: 972,668

[22] Filed: Dec. 26, 1978

[51] Int. Cl.[2] ..... B01F 5/06

[52] U.S. Cl. ..... 366/337; 366/340

[58] Field of Search ..... 366/337, 336, 338, 340, 366/9, 341; 138/38, 42

[56] References Cited

U.S. PATENT DOCUMENTS

| | | | |
|---|---|---|---|
| 846,751 | 3/1907 | Melvin | 366/9 |
| 969,372 | 9/1910 | Hottel | 366/340 |
| 1,583,833 | 5/1926 | Howell | 366/340 |
| 3,045,984 | 7/1962 | Cochran | 366/340 |
| 3,275,304 | 9/1966 | Brundrett | 366/337 |
| 3,620,506 | 11/1971 | So | 366/337 |
| 3,893,654 | 7/1975 | Miura | 366/337 |

OTHER PUBLICATIONS

Perry & Chilton–Chem. Eng. Handbook 5th ed. pp. 19–24.

Chemical Processing, Jul. 1967, p. 103.

*Primary Examiner*—Robert W. Jenkins

*Attorney, Agent, or Firm*—Armstrong, Nikaido, Marmelstein & Kubovcik

[57] ABSTRACT

A gravity mixer for fluent materials in which material flows downwardly through a column sequentially along a number of helical paths where it comes into contact with multiple perforated flights which divide the material and divert portions onto other flights for combining and mixing with other portions of material in different paths, thus advancing portions of material and retarding other portions and continuously blending the portions as they are brought together during the fall through the column.

8 Claims, 4 Drawing Figures

GRAVITY FLOW CONTINUOUS MIXER

BACKGROUND OF THE INVENTION

In mixing fluent materials, particularly dry fluent solids, considerable difficulty is encountered in obtaining uniform compositions of the final mixes. The difficulties are partly attributable to variations in the particle sizes of the materials being mixed and sometimes to variations in densities of the materials. Even with utmost accuracy in proportioning and weighing of the ingradients, uniformity of the final product is difficult to obtain. Notwithstanding these difficulties, it is necessary in many operations and particularly in chemical analyses to obtain a product of a high degree of uniformity.

Various methods have been tried for insuring uniformity of the products. Many of the methods require expensive working and reworking of the material, a circumstance which in unacceptable by the present day highspeed operations of commerce, both from the standpoint of time consumed and the expense and energy required for such operations. If physical characteristics, for example, particle size, particle shape, particle density and the rheological properties of the materials vary widely among the various components, handling and processing equipment must be provided to cope with the most unfavorable combinations of such conditions.

In commercial operations, the type of blending employed will depend on such factors as the homogeneity requirements of the final product, variances in the physical and chemical properties of the components, the tendency of the components to segregate on storage and the like. When dry solids are mixed, as in the manufacture of fertilizers, the streams can be proportioned with a relatively high degree of accuracy. However, for bulk operations where the value of the product will not justify expensive mixing and blending equipment, uniformity of the product is frequently lacking. Some producers attempt to overcome non-uniformity of product by adding an overage of required components so that operational variations will be compensated for by the additional material. This is expensive from the standpoint of material which is given away. Furthermore, it is not always acceptable because some of the industry regulatory agencies will not permit overages above certain fixed limits just as they will not permit shortages. Thus, where variations are of considerable magnitude, it is not always possible to satisfy the requirements of the regulatory agencies by adding more material than would be required normally. For these reasons, it is desirable that more effective methods be found for achieving final blends of uniform composition.

DESCRIPTION OF THE PRIOR ART

Heretofore, in mixing dry solids, the practice has been to tumble a batch of the components in a rotating vessel or to mix the components in a stationary vessel fitted with moving blades or by plug-flow of the materials past segments of helices in a cylinder. Mixtures of liquids, suspensions or pastes have been obtained by mixing the liquid components in vessels fitted with agitators such as blades or paddles, or by passing the components through pug-mills or through cylinders equipped with helices for stirring the liquids. Significant energy is required in all cases except for plug-flow past segments of helices, which can be accomplished by gravity flow or by pumping. The mixing devices of the prior art are characterized by deficiencies primarily in that they ae directed to blending of material at a specific point in the equipment with little or no provision for retarding material or accelerating its flow during mixing to insure a greater uniformity in the final stream.

SUMMARY OF THE INVENTION

In accordance with the present invention, I have developed a mixer with no moving parts in which mixing is accomplished by gravity flow of the material from top to bottom of the mixer across fixed sloping surfaces or flights so arranged as to cause material to rotate in paths around a vertical axis and by means of perforations or openings in the surfaces and by means of many abrupt changes in direction and diversions from one path to another, to flow in paths of different lengths through the mixer. The flow is induced by gravity and the only energy employed is that required to elevate the material to the top of the mixer. This gravity flow continuous mixer avoids undesirable plug-flow and channelling of material in its passage through the mixer. Throughout its length, the mixer attenuates the moving stream so that some material advances more rapidly than other and mixes with material which has already entered, while other material is diverted to paths which move more slowly and is mixed with material which has entered the mixer later. The result is a more uniform blending of materials of widely varying physical properties.

Mixing and attenuation are accomplished by inclined surfaces arranged around a vertical axis in sets or tiers extending inwardly from the walls of the mixer. The number of sets influences the extent of mixing and the interval between sets determines how many times the total flow will be divided into individual portions and recombined with other portions. Since the flights are arranged in sets, the material falls from one flight to a lower flight so that there is a change in direction from sliding across a fixed inclined surface to free fall to a lower surface. Further mixing and flow of material is accomplished by diverting portions of material through openings in the flights which causes such portions to fall or short-circuit to the surface immediately below. The extent of mixing depends on: (1) the number of flights in a set; (2) the number of sets; (3) the distance between sets; (4) the relative area of the openings in the surfaces of the flights through which material can fall; (5) the arrangement of the openings in the flights; (6) the angle of inclination of the flights; and (7) the area of the flights.

DESCRIPTION OF THE PREFERRED EMBODIMENT

Figure 2:
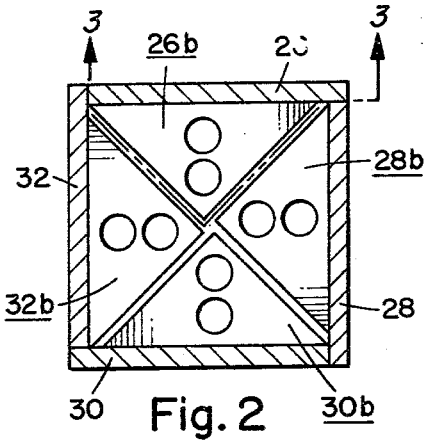
FIG. 2 is a cross sectional view of FIG. 1 taken along line 2—2 showing the arrangement of flights in a four-sided mixer.
Figure 1:
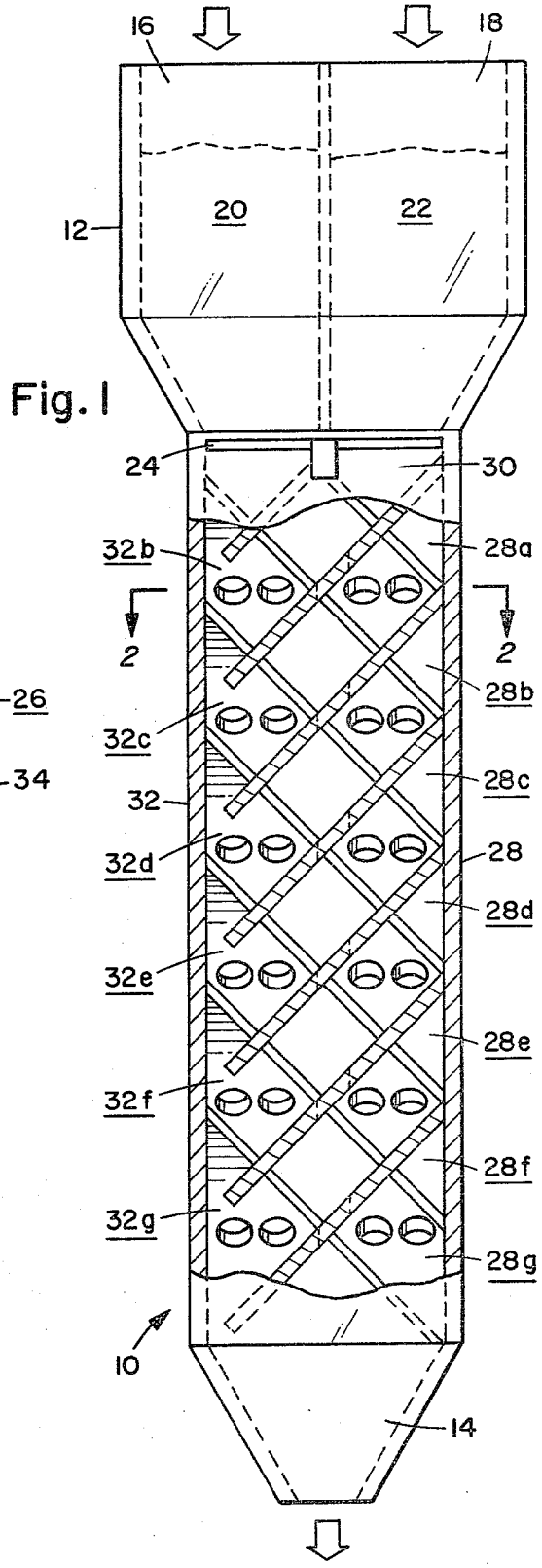
FIG. 1 is a perspective view, partly in section of a mixer of the present invention showing the arrangement of flights within the apparatus.
Figure 3:
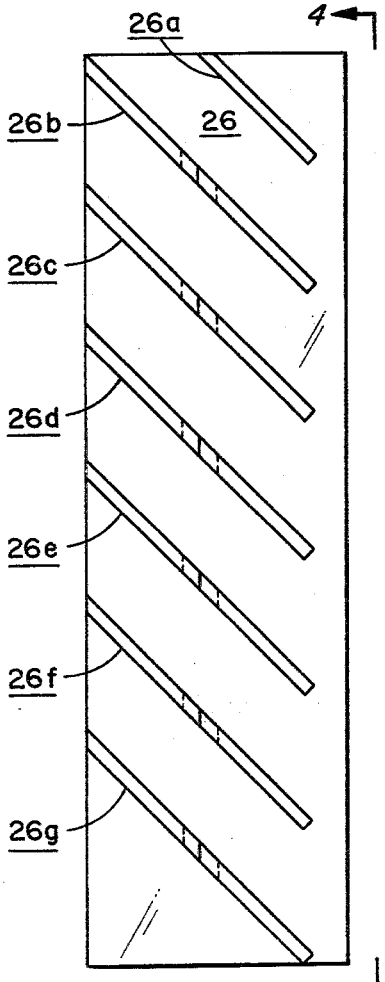
FIG. 3 is a side view of one wall of the mixer shown in FIG. 2.
Figure 4:
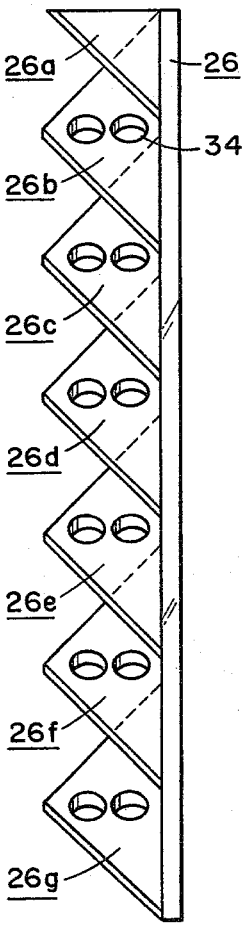
FIG. 4 is a view of the sidewall with the flights shown in FIG. 3 viewed along the line 4—4.

The present invention will be further described with reference to the drawings, referring, at first, to FIG. 1, which shows an overall complete mixer of the present invention. The apparatus includes a mixing zone 10, a feed hopper 12 above and a collector 14 below. Hopper 12 may be divided into bins shown at 16 and 18. Additional bins may be provided as needed for the particular purpose for which the mixer is to be used. Instead of a conventional hopper or in addition thereto, it may be desirable to use my three-dimensional quincunx mixer, which is the subject of another application Ser. No. 972,667 filed Dec. 26, 1978. This quincunx mixer would provide better distribution of material over the entire cross-sectional area of the mixer 10. Flow of material 20 and 22 into mixer 10 is controlled by appropriate means here shown as a slide gate 24, the rate of flow being controlled by the size of the opening in the gate through which material is allowed to flow. Desirably, the material being fed into mixer 10 is uniformly distributed over the entire cross-sectional area so that substantially equal quantities strike the first flights at the top of the mixer 10. In its fall through the mixer 10, the material will undergo a multiplicity of divisions, diversions, abrupt changes in direction, and recombinations, all of which provides a thorough blending of the materials.

Mixer 10 is shown as a polygonal vessel having four sides 26, 28, 30 and 32. Arranged in tiers and extending inwardly from the sides are flights a, b, c, d, e, f and g. In the apparatus shown, these flights are triangular and they slope along the walls to which they are attached. The flights are positioned with respect to the flights on adjacent walls to define a plurality of stacked square helical paths along which material flows in moving from the top to bottom of mixer 10. The flights in the top set are truncated as shown at 26*a*. However, these truncated flights can be omitted, if desired, but they cause better distribution of the material and act as an additional set of flights. Each of the flights 26 is provided with one or more openings 34 near the middle. These openings are here shown as pairs of holes in the center of each flight. These openings may be single or plural and they may be positioned uniformly above each other in the tiers. They may be offset somewhat so that material falling through each will be sure to strike the flight below and will not short-circuit to the bottom of the mixer. The placement of these openings 34 will depend somewhat on the flow characteristics of the material being mixed. It may be desirable to provide a deflector plate on the under side of the flights below the openings 34 to prevent such short-circuiting if that is a problem. In some situations, short-cirsuiting is desirable. Also, in some situations, some of the flights may not be provided with holes 34.

In operation, material flows from hopper 12 through gate 24, strikes the flights in the first set and tumbles, slides or otherwise flows downwardly towards the lower edge of the flights. A portion of it is diverted through openings 34 to the flights immediately below, which flights are in a different helical path from the one from which the material fell. Another portion of the material adjacent to the vertical axis of the mixer is intercepted by and diverted onto the flight on the downstream wall but in the helical path immediately above for mixing with material flowing across it. Material on the peripheral side of each flight flows onto the next flight downstream on the adjacent wall in the same helical path. Because of the motion of the flowing material, the peripheral portion will strike the adjacent wall and will be deflected back toward the middle of the flight onto which it is falling. This further improves the degree of mixing. Thus, on each flight, the material is divided into three portions and these are combined with other material and caused to move downstream in three separate paths.

In the four-sided mixer shown in the drawings, material flowing from top to bottom will flow in eight different helical paths. As explained, a portion of material on each flight is diverted through the openings 34 to the path immediately below, another portion is diverted to the path immediately above but at a lower point of entrance and a third portion continues along the same path for combining with material being added to that path. As each portion of material leaves a flight, it is caused to fall freely for a short distance to the next flight, the exact distance depending on the point at which the material leaves the flight. Thus, the material on each flight is made up of three portions of material from three different points in the stream. Because of this multiplicity of divisions, diversions, free-falls and recombinations, the material reaching collector 14 is a uniform blend of the material in the mixer at that time.

This mixer is particularly suited for mixing bulk materials such as dry fertilizers which usually comprise at least three components of different different physical characteristics and subject to serious segregation during handling. With the mixer of the present invention, it is possible to obtain a quite uniform blend of product. It is also useful in preparation of laboratory samples because a single pass through the mixer is equivalent to several rotations of a typical blender found in many laboratories.

The mixer of the present invention can also be used as a storage tank and once it is filled, material moving downward will undergo the same divisions, diversions and recombinations described above although the deflections will not be as violent as with fast-moving material. Material stored in this mixer will not be subject to segregation that normally occurs when material as added to or withdrawn from an ordinary tank.

While I have described my apparatus particularly in terms of its use in mixing dry fluent solids, it can be effectively used for mixing liquids and even gases. With gases which are lighter than air, the flow would be from bottom to top and the mixing would occur on the undersides of the flights.

Other uses and advantages will occur to those skilled in the art and are fully contemplated herein.

While I have described my mixer as having four sides, it is to be understood that it can have any desired polygonal shape and can even be round. However, a four-sided shape is preferred because it is most efficient in uniformly of results and in ease of construction and integration into usual plant facilities.

Operation of the apparatus of the present invention is demonstrated by tests which I carried out using a small model embodying the present invention. The mixer was a four-sided device about 10 inches (25.4 cm) high with sides 2 inches (5.1 cm) wide. There were 9 sets of flights with an additional truncated set at the top. Each flight was set at an angle of 45 degrees along the walls to which it was attached. Each flight except the four truncated ones had two holes of about 0.25 inches (0.64 cm) diameter in the middle. Spacing between the flights was about 11/16 inches (1.75 cm). With this mumber of flights and the indicated spacing, material passing from the top to the bottom made at least one complete turn around the vertical axis.

The mixer was placed on top of a clear receiving cylinder about 10 inches (25.4 cm) high having a diameter of 1.5 inches (3.8 cm). A feed hopper comprising a pair of longitudinally truncated cylinders about 6 inches (15.2 cm) in diameter, and each having a bottom which sloped towards a slit outlet was set on top of the mixer. The openings were closed by a slide gate for controlling the size of the opening.

The first tests were carried out with table salt, a portion of which had been dyed with a vegetable dye and dried. The other portion was used as it came from the container. One of the tubular compartments of the hopper was filled with untreated salt and the other was filled with dyed salt. The two materials were fed into the mixer at the same rate until the hopper was empty on one side at which time, the gate was closed. The material passed through the mixer without bridging or sticking. Visual examination ot the material in the collecting cylinder showed that it was uniformly blended from top to bottom.

Numerous additional tests were made using the same starting materials but feeding them to the mixer at a different rate for each test. Regardless of the rate of feed, the final product was uniformly blended in each case.

Another test was run using cream of wheat as the starting material. One portion had been dyed and dried and the other portion was used in untreated form. The product was a uniform blend of the two.

Obvious modifications and changes can be made in the apparatus without departing from the spirit of the invention, the scope of which is defined by the following claims.

I claim:

1. A method of blending fluent material comprising the steps of introducing said material into an upper portion of an upright mixing zone, dividing said material for fall through said zone along a plurality of helical paths to the bottom of said zone, periodically diverting a first portion of said material from each of said paths to a next lower helical path for combination with material therein, diverting a second portion to a helical path below said next lower helical path for combination with material therein, causing a multiplicity of abrupt changes in direction of flow, by which divisions, diversions, combinations and direction changes there is produced at the bottom of said zone a uniformly blended material.

2. A method for blending fluent material comprising introducing said material into an upper portion of an elongated upright mixing zone, causing said material to flow downwardly through said zone in a plurality of segmented layers along a plurality of intermeshed helical paths, diverting a portion of material of each segment to a lower segment of the next lower helical path for combining with material in said path, diverting a second portion of material of each segment to a segment immediately below in the next lower helical path for combining with material thereof, causing multiple abrupt changes of direction in said paths, both horizontally and vertically, thereby moving portions of material irregularly with respect to other portions and collecting said material from all paths at the lower end of said zone.

3. Apparatus for blending fluent material comprising an elongated polygonal chamber having an inlet and an outlet in its upper and lower ends respectively, a plurality of tiered flights extending inwardly from the walls of said chamber and forming a barrier to the free fall of material through said chamber, each of said flights being intercepted near the midpoint of its downstream edge by the upper edge of the flight of the next lower set on the adjacent wall of said chamber and terminating at its lowest point in the corner formed by the supporting wall and the adjacent wall of said chamber just above the highest point of the flight of the second lower set on the adjacent wall, said flights having openings in their faces to divert a portion of material from said flights to the next lower coincident flights immediately below, whereby material introduced through said inlet is subjected to a plurality of changes of direction, divisions, and combinations in its fall through said chamber.

4. Apparatus for blending fluent material comprising an upright column having an inlet at its upper end and an outlet at its lower end, a plurality of tiers of inclined flights extending inwardly from the sides of said column arranged to provide a plurality of stacked helical paths for said fluent material and being positioned with respect to adjacent flights to deliver material to flights in a plurality of paths for mixing with material therein and being further positioned so that material leaving each flight falls unsupported to a lower flight, the number of paths created increasing in a manner dependent upon the number of tiers and flights.

5. The apparatus of claim 4 having a polygonal cross-section, wherein said tiers form a plurality of polygonal helical paths for material flowing through said column and wherein each of said flights delivers material to flights in at least three helical paths.

6. The apparatus of claim 5 having a rectangular cross-section and triangular flights.

7. The apparatus of claim 6 having a square cross-section.

8. Apparatus for blending fluent material as in claim 4 wherein the number of paths increases exponentially between tiers.

* * * * *